US010173702B2

(12) United States Patent
Huchrowski

(10) Patent No.: US 10,173,702 B2
(45) Date of Patent: Jan. 8, 2019

(54) TRAIN PARKING OR MOVEMENT VERIFICATION AND MONITORING SYSTEM AND METHOD

(71) Applicant: Westinghouse Air Brake Technologies Corporation, Wilmerding, PA (US)

(72) Inventor: Frank Huchrowski, North Versailles, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 132 days.

(21) Appl. No.: 14/849,347

(22) Filed: Sep. 9, 2015

(65) Prior Publication Data

US 2017/0066458 A1 Mar. 9, 2017

(51) Int. Cl.
*B61L 15/00* (2006.01)

(52) U.S. Cl.
CPC ..... *B61L 15/0081* (2013.01); *B61L 15/009* (2013.01); *B61L 15/0063* (2013.01); *B61L 15/0072* (2013.01)

(58) Field of Classification Search
USPC ..... 701/96
See application file for complete search history.

(56) References Cited

U.S. PATENT DOCUMENTS 2,693,562 A * 11/1954 Purifoy ..... B60L 7/04 318/251
3,596,500 A * 8/1971 Rees ..... B60T 17/228 269/27
3,670,660 A 6/1972 Weber et al.
4,550,598 A * 11/1985 Breedyk ..... G01M 17/02 33/773
4,771,387 A * 9/1988 Hexel ..... B60T 8/88 340/453
4,817,019 A * 3/1989 Morihara ..... G01D 18/00 701/33.4
4,855,709 A * 8/1989 Naderi ..... B60R 16/0232 340/438
5,402,674 A * 4/1995 Ganzhorn, Jr. ..... G01L 5/282 73/116.06
5,563,353 A * 10/1996 Ferri ..... G01F 1/363 305/15
5,621,657 A * 4/1997 Ferri ..... B60T 17/228 303/155
5,787,371 A * 7/1998 Balukin ..... B60L 15/32 246/187 A
5,815,823 A * 9/1998 Engle ..... B60L 15/38 246/187 C (Continued)

FOREIGN PATENT DOCUMENTS

CN 205249406 U * 5/2016
EP 1790544 * 5/2007
WO WO 2005077726 A1 * 8/2005

OTHER PUBLICATIONS

Wolf, "It Takes Three to Rock and Roll", Rail Sciences, Inc., Feb. 2005, p. 1-3.

(Continued)

*Primary Examiner* — Jean Paul Cass
(74) *Attorney, Agent, or Firm* — The Webb Law Firm

(57) ABSTRACT

A parking verification system and method, a movement verification system and method, and a monitoring system and method for a train, or other transit vehicle.

16 Claims, 2 Drawing Sheets

(56) References Cited

U.S. PATENT DOCUMENTS 5,816,541 A 10/1998 Joyce, Jr. et al.
6,008,731 A * 12/1999 Capan ..... B61L 1/14 246/167 R
6,122,571 A 9/2000 Gerstner et al.
6,279,689 B1 * 8/2001 Zemyan ..... B60T 13/581 188/153 R
6,378,668 B1 * 4/2002 Zemyan ..... B60T 7/08 188/153 R
6,609,049 B1 8/2003 Kane et al.
6,824,110 B2 11/2004 Kane et al.
7,006,957 B2 2/2006 Doner
7,110,880 B2 9/2006 Breed et al.
7,124,691 B2 10/2006 Donnelly et al.
7,200,471 B2 4/2007 Kane et al.
7,518,489 B2 4/2009 Nelson et al.
8,493,198 B1 * 7/2013 Vasquez ..... B60Q 9/008 340/425.5
8,509,971 B1 8/2013 Isailovski et al.
9,183,560 B2 * 11/2015 Abelow ..... G06Q 10/067
9,463,817 B2 * 10/2016 Kupiec ..... B61L 15/0081
2001/0056544 A1 * 12/2001 Walker ..... B60R 25/02 726/2
2002/0032088 A1 * 3/2002 Korenjak ..... F01B 1/12 474/14
2002/0033295 A1 * 3/2002 Korenjak ..... F01B 1/12 180/292
2002/0176605 A1 * 11/2002 Stafsudd ..... G06K 9/3241 382/106
2003/0006644 A1 * 1/2003 MacGregor ..... B60T 7/10 303/3
2003/0221922 A1 12/2003 Callow
2004/0056779 A1 * 3/2004 Rast ..... B63B 22/16 340/985
2004/0099176 A1 * 5/2004 Yokonishi ..... B61D 35/007 105/26.1
2005/0082126 A1 * 4/2005 Engle ..... B60T 7/047 188/265
2006/0016647 A1 * 1/2006 Engle ..... B60T 7/047 188/235
2006/0026017 A1 * 2/2006 Walker ..... G06Q 10/00 701/31.4
2006/0206246 A1 * 9/2006 Walker ..... G06Q 10/00 701/16
2008/0028845 A1 * 2/2008 Seibl ..... G01L 5/282 73/123
2008/0174415 A1 * 7/2008 Tanida ..... B60Q 9/00 340/438
2008/0208393 A1 8/2008 Schricker
2009/0048725 A1 2/2009 Kane et al.
2010/0322476 A1 * 12/2010 Kanhere ..... G08G 1/0175 382/103
2011/0127389 A1 * 6/2011 Bartek ..... B61L 1/02 246/124
2011/0307155 A1 12/2011 Simard
2012/0265379 A1 10/2012 Chen et al.
2013/0006443 A1 1/2013 Woo et al.
2013/0151041 A1 6/2013 Otsubo et al.
2013/0182114 A1 * 7/2013 Zhang ..... H04N 7/18 348/150
2013/0191070 A1 * 7/2013 Kainer ..... B61K 9/08 702/167
2013/0304286 A1 11/2013 Ehrler et al.
2014/0088801 A1 * 3/2014 Bartonek ..... G01M 17/08 701/19
2016/0033289 A1 * 2/2016 Tuukkanen ..... G01C 21/3415 701/522
2016/0075210 A1 * 3/2016 Quaranta-Guido ..... B60Q 9/00 701/48

OTHER PUBLICATIONS

Egan, "Understanding the Rail Environment: Intrinsic Forces in Rail Operation", RSI Rail Sciences, Jun. 18, 2013, p. 1-75.
Laine et al., "A high-sensitivity MEMS-based accelerometer", The Leading Edge, Nov. 2014, p. 1234-1242.
Wikipedia, "Accelerometer", https://en.wikipedia.org/wiki/Accelerometer, printed from internet Dec. 1, 2015.
"STMicroelectronics Reveals Top-Performing MEMS Accelerometer for Richer User Experiences", Aug. 30, 2013, http://www.st.com/web/en/news/n3459.
Schneyer et al., "Insight: Quebec train set too few brakes, with deadly result", Reuters, Jul. 10, 2013.
Electro Pneumatic Controlled Freight Brake System (ECP) General Overview, Wabtec Presentation, as published on http://docslide.us on Mar. 26, 2015, 3 slides.

* cited by examiner

TRAIN PARKING OR MOVEMENT VERIFICATION AND MONITORING SYSTEM AND METHOD

BACKGROUND OF THE INVENTION

Field of the Invention

This invention relates generally to verification and monitoring processes related to vehicle systems, such as railway systems including trains travelling in a track or rail network, and in particular to improved train parking or movement verification and monitoring systems and methods.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. Such train control systems normally include at least one on-board computer (or controller) that is used to manage and control the various actions of the train through interaction with the operator.

As is known, braking systems and arrangements are required for slowing and stopping vehicles, such as cars, trucks, trains, railcars, railway vehicles, locomotives, and the like. With specific respect to trains and other railway vehicles, the braking system is normally in the form of a pneumatically-driven arrangement (or "air brake arrangement") having mechanisms and components that interact with each railcar. A known air brake system (BA) is illustrated in schematic form in FIG. 1.

With reference to FIG. 1, and as is known, the operator of a train (TR) has control over the braking system (BA) through the use of an operator control valve (CV). Through the movement of a handle associated with the control valve (CV), the operator can adjust the amount of braking to be applied in the air brake system (BA). The higher the braking force selected, the faster the braking system (BA) will slow and stop the train TR. Alternatively, and as discussed in more detail hereinafter, the air brake system (BA) for each railcar may also be controlled by the operator from an on-board computer (OBC) (which may be in the form of a control system, a train management computer, a computing device, a processor, and/or the like) in the locomotive that transmits data signals over a trainline (TL) (or cable extending between the locomotive and the railcars), which may be referred to as an electronically-controlled pneumatic (ECP) air brake arrangement.

In order to provide the appropriately compressed air to the system, and in certain conventional air brake applications, the air brake system (BA) also includes a compressor (C) for providing compressed air to a main reservoir (MR). Further, an equalizing reservoir (ER) is also in communication with the control valve (CV). Whether through the main reservoir (MR) or the equalizing reservoir (ER), compressed air is supplied through the control valve (CV) to a brake pipe (BP) that extends along and is associated with each railcar. Each railcar includes an arrangement that allows an auxiliary reservoir (AR) to be charged with air via a valve (V), as well as an air brake arrangement (ABB), which includes a brake cylinder (BC) in communication with the valve (V). The brake cylinder (BC) is operable to move a brake beam (BB), which is operationally connected to one or more brake shoes (BS), towards and/or against a surface of a wheel (W).

In operation, the brake pipe (BP) is continually charged to maintain a specific pressure, e.g., 90 psi, and each of the auxiliary reservoir (AR) and emergency reservoir (ER) (which may be combined into a single volume, or main reservoir) are similarly charged from the brake pipe (BP). In order to brake the train (TR), the operator actuates the control valve (CV) and removes air from the brake pipe (BP), thereby reducing pressure to a lower level, e.g., 80 psi. The valve arrangement (V) quits charging the auxiliary reservoir (AR) and transfers air from the auxiliary reservoir (AR) to the brake cylinder (BC). Normally, using piston-operable arrangement, the brake cylinder (BC) moves the brake beam (BB) (and, accordingly, the brake shoe (BS)) towards and against the wheel (W). As discussed, in conventional, non-ECP air brake systems, the operator may adjust the level of braking using the control valve (CV), since the amount of pressure removed from the brake pipe (BP) results in a specific pressure in the brake cylinder (BC), which results in a specific application force of the brake shoe (BS) against the wheel (W). Alternatively, in the ECP air brake systems, the brake commands are electronic and transmitted over the ECP trainline (TL) to each railcar. Using the above-described air brake system (BA), the train can be slowed and/or stopped during operation and as it traverses the track. Further, each railcar is normally equipped with a (typically manual) hand brake arrangement (HB) for securing each car when parked or stopped, and in order to ensure that the train (TR) does not move or shift.

In order to provide further control to the air brake arrangement (BA), and as discussed above, ECP brake arrangements can be used. In such ECP systems, control signals can be transmitted from the on-board computer (OBC), typically located in the cabin of the locomotive and in communication with a display mechanism (i.e., the operator interface), to one or more of the railcars over the trainline (TL). Each railcar is normally equipped with a local controller (LC), which is used to monitor and/or control certain operating parameters in the air brake arrangement (ABB), such as in the air reservoirs and/or the valve arrangement (V). In this manner, the operator can broadcast brake commands to the railcars to ensure a smooth, efficient, and effective braking operation. This local controller (LC) typically includes the appropriate processor and components to monitor and/or control various components of the air brake system (BA) and/or the specific air brake arrangement (ABB).

As discussed above, conventional freight cars include hand brake arrangements (HB), which provide a mechanical locking of brakes, normally based upon user operation of a wheel (W) to apply force to a chain connected to a brake lever system (which is connected to the brake beam (BB)). Actuation of these hand brake arrangements (HB) cause the brake shoes (BS) to contact the wheels (W) via movement of the brake beams (BB). Operating rules have been established by railroads, which require application of the hand brake arrangement (HB) under a variety of conditions. The most common condition is when "setting a car off" from the train (TR) in order to park it in a yard or siding track. However, as referred to above, the hand brake arrangements (HB) are also used to secure the train (TR) under failure (or emergency) conditions when in mainline operation. For example, these hand brake arrangements (HB) may be used when the train (TR) failure exists, where the locomotives are no longer able to maintain brake pipe (BP) pressure. Another such condition exists when a crew needs to secure the train (TR) and leave the locomotive unmanned. A still further condition arises when the train (TR) suffers a "break-in-two" event, leaving a group of cars without a locomotive.

The "break-in-two" event and other conditions requiring the stopping of a train (TR) are addressed through exhausting the brake pipe (BP), which will lead to an emergency brake application. Typical air brake systems, even if maintained to AAR standards, can have a brake cylinder leak rate of up to 1 psi per minute, which are considered to be within acceptable leakage rates. This level is normally used to provide a time guideline for train crews to gauge when to manually apply the hand brake arrangements (HB) and secure the train (TR). The number of cars that require this hand brake arrangement (HB) application may vary based on the number of cars in the train consist, the train weight, the track location, the average grade of the track, and similar factors and conditions. Crews normally need to apply the hand brake arrangements (HB) within about one-half hour after the condition arises, and after the hand brake arrangements (HB) are applied, the brake cylinder BC can leak to zero, such that the car will be secured.

As discussed above, it is important that there is some verification that all (or a specified set) of the hand brake arrangements are activated or set prior to leaving the train (TR) unmanned. For example, and as discussed, due to leakage of the reservoirs of the railcars, it is possible that such leakage will lead to a disengagement between the brake shoes (BS) and the wheels (W) (such that the train (or railcar) is free to move, which demonstrates the need to ensure that the hand brake arrangements (HB) are set. Similarly, when a parked train (TR) is ready to be put back in active service, the reverse steps are taken.

The more monitoring and verification information that the operator obtains with respect to the parameters of the train, the greater the ability to effectively control and manage the operation of the train (TR). In addition, the ability to automate some or all of these monitoring and verification processes or procedures leads to a safer operation and environment. Accordingly, there is a need in the art to provide monitoring features with respect to detecting or monitoring the movement or non-movement of the train (TR). There is also a need in the art to provide a verification process associated with the parking of the train (TR) and/or the subsequent movement of the train (TR).

SUMMARY OF THE INVENTION

Generally, provided are improved train parking or movement verification and monitoring systems and methods for use in connection with trains travelling in a track network. Preferably, provided are train parking or movement verification and monitoring systems and methods that provide monitoring and verification features that result in computer-implemented processes for use in connection with a train. Preferably, provided are train parking or movement verification and monitoring systems and methods that provide an automated process that improves safe parking and movement of the train. Preferably, provided are train parking or movement verification and monitoring systems and methods that facilitate crew interaction and input to ensure safe parking and operation of a train.

According to one preferred and non-limiting embodiment or aspect, provided is a parking verification system for a train having a braking a system, at least one locomotive, and at least one railcar, wherein the at least one locomotive and/or the at least one railcar is equipped with at least one manually-operated parking assembly, the system comprising: at least one on-board computer associated with the train and programmed or configured to: (a) when the train is not moving, generate braking system test data related to at least one braking system parameter; (b) based at least partially on the braking system test data: (i) generate alarm data or (ii) initiate a non-parked mode for the train; (c) after initiating non-parked mode and movement of the train, determine whether the train has subsequently stopped moving; and (d) repeat steps (a) and (b).

In one preferred and non-limiting embodiment or aspect, the parking verification system further comprises at least one operator interface programmed or configured to receive operator input. In another preferred and non-limiting embodiment or aspect, the on-board computer is further programmed or configured to generate at least one query requesting the input of train data. In another preferred and non-limiting embodiment or aspect, the train data comprises at least one of the following: operator name, operator identification, identification data, contact data, locomotive data, consist data, railcar data, location data, weight data, speed data, time data, grade data, payload data, braking system data, or any combination thereof. In another preferred and non-limiting embodiment or aspect, the on-board computer is further programmed or configured to generate at least one query requesting the input of braking system data. In another preferred and non-limiting embodiment or aspect, the braking system test data is at least partially based on at least a portion of the braking system data. In another preferred and non-limiting embodiment or aspect, at least a portion of the alarm data is visually displayed on the at least one operator interface.

In one preferred and non-limiting embodiment or aspect, the alarm data comprises at least one of the following: visual data, aural data, tactile data, braking system test data, braking system data, train data, braking system parameter data, or any combination thereof.

In one preferred and non-limiting embodiment or aspect, provided is a parking verification system for a train having a braking system, at least one locomotive, and at least one railcar, wherein the at least one locomotive and/or the at least one railcar is equipped with at least one manually-operated parking assembly, the system comprising: at least one on-board computer associated with the train and programmed or configured to: (a) initiate a parking verification process; (b) determine or receive train data; (c) verify at least one train parameter; (d) generate at least one prompt to activate at least one manually-operated parking assembly of at least one locomotive and/or at least one railcar; and (e) based upon operator input related to the at least one prompt, generate at least one prompt to activate or deactivate at least one component of the braking system.

In one preferred and non-limiting embodiment or aspect, the train data comprises at least one of the following: operator name, operator identification, identification data, contact data, locomotive data, consist data, railcar data, location data, weight data, speed data, time data, grade data, payload data, braking system data, or any combination thereof.

In one preferred and non-limiting embodiment or aspect, the at least one train parameter comprises at least one of the following: locomotive data, braking system parameter data, or any combination thereof. In one preferred and non-limiting embodiment or aspect, step (c) further comprises: (c)(1) verification that the speed of the at least one locomotive is zero; (c)(2) verification that brake pipe pressure has been reduced; and (c)(3) verification that locomotive cylinder pressure has been applied.

In one preferred and non-limiting embodiment or aspect, step (d) further comprises determining, by the at least one on-board computer, specific locomotives and/or specific railcars on which the manually-operated braking assembly should be activated. In another preferred and non-limiting embodiment or aspect, the determination is at least partially based upon the grade of the track upon which the train is parked.

In one preferred and non-limiting embodiment or aspect, prior to step (e), the at least one on-board computer is further programmed or configured to wait for a specified period of time. In another preferred and non-limiting embodiment or aspect, the specified period of time is at least partially based upon at least one of the following: a number of manually-operated braking assemblies to be activated, a position of at least one manually-operated braking assembly to be activated, train data, track data, environment data, weather data, or any combination thereof.

In one preferred and non-limiting embodiment or aspect, the at least one on-board computer is further programmed or configured to verify the activation or deactivation of the at least one component of the braking system.

In one preferred and non-limiting embodiment or aspect, the at least one on-board computer is further programmed or configured to: (f) generate at least one prompt to activate at least one throttle control component; (g) verify that the at least one throttle control component has been activated; and (h) determine whether the train has moved in response to the activation of the throttle control component. In another preferred and non-limiting embodiment or aspect, step (f) comprises at least one prompt to activate the at least one throttle control component to cause the train to move in at least one of a forward direction and a reverse direction. In another preferred and non-limiting embodiment or aspect, the at least one prompt further comprises an instruction to continue activating the at least one throttle control component for a specified period of time.

In another preferred and non-limiting embodiment or aspect, step (g) comprises at least one of the following: (i) receiving feedback from at least one component of the train; (ii) receiving feedback from at least one sensor of the train; or any combination thereof. In one preferred and non-limiting embodiment or aspect, step (h) comprises at least one of the following: (i) determining movement data at least partially based upon feedback from at least one component of the train; (ii) determining movement data at least partially based upon feedback from at least one sensor of the train; (iii) determining movement data at least partially based upon determined or sensed motor current; (iv) determining movement data at least partially based upon user input; or any combination thereof.

In one preferred and non-limiting embodiment or aspect, the at least one on-board computer is programmed or configured to enter at least one parked mode. In another preferred and non-limiting embodiment or aspect, the at least one on-board computer is programmed or configured to: (i) terminate the at least one parked mode; and (ii) communicate or cause the communication of at least one message that the at least one parked mode has been or will be terminated. In another preferred and non-limiting embodiment or aspect, the at least one on-board computer is programmed or configured to communicate or cause the communication of at least one message to activate or deactivate at least one component of the braking system or at least one manually-operated braking assembly.

In one preferred and non-limiting embodiment or aspect, at least one step of a procedure directed to or associated with parking verification process is stored in at least one database. In one preferred and non-limiting embodiment or aspect, and while the train is parked, the at least one on-board computer is further programmed or configured to: determine or detect whether the train is moving; and if train movement is determined or detected, generate alarm data. In another preferred and non-limiting embodiment or aspect, the determination or detection of movement comprises at least one of the following: sensing or determining rotation or movement of an independent rotating structure; sensing or determining movement of at least one railcar; sensing or determining movement of at least one end-of-train device; collecting and processing visual data; collecting and processing radar data; collecting and processing position data; collecting and processing accelerometer data; or any combination thereof.

In one preferred and non-limiting embodiment or aspect, and while the train is parked, at least one computer is programmed or configured to determine or detect at least one of the following: (i) activation of or interaction with at least one throttle control component; (ii) operation of or interaction with at least one manual release rod; (iii) operation of or interaction with at least one hand brake arrangement; (iv) operation of or interaction with at least one component of the braking system; (v) operation of or interaction with at least one component of a manifold; (vi) operation of or interaction with at least one actuator; (vii) a pressure change in at least one component of the braking system; (viii) a pressure drop in at least one component of the braking system; or any combination thereof. In one preferred and non-limiting embodiment or aspect, and while the train is parked, the at least one on-board computer is programmed or configured to: determine or detect activation of or interaction with at least one component of the braking system or the manually-operated parking assembly; and if activation or interaction is determined or detected, generate alarm data. In one preferred and non-limiting embodiment or aspect, and while the train is parked, the at least one on-board computer is programmed or configured to: determine or detect a change in at least one braking system parameter; and if change is determined or detected, generate alarm data.

In a further preferred and non-limiting embodiment or aspect, provided is a parked train monitoring system for a train having a braking a system, at least one locomotive, and at least one railcar, wherein the at least one locomotive and/or the at least one railcar is equipped with at least one manually-operated parking assembly, the system comprising: at least one on-board computer associated with the train and programmed or configured to: (a) when the train is not moving, determine or detect at least one of the following: (i) the length of time that the train has not moved, (ii) the length of time that at least one component of the braking system has been activated, (iii) whether a specified process or procedure has been initiated or completed, or any combination thereof; and (b) based at least partially on the determination or detection, generate alarm data.

In one preferred and non-limiting embodiment or aspect, and based at least partially on at least a portion of the alarm data, the at least one on-board computer is programmed or configured to implement or cause at least one of the following: an audible alarm in the at least one locomotive; activation of a horn or bell of the train; powering of at least one light associated with the train; communication of at least one message to at least one user; communication of at least one message to a remote server; or any combination thereof.

In another preferred and non-limiting embodiment or aspect, provided is a movement detection system for a train having at least one locomotive and at least one railcar, comprising: at least one visual data collection device programmed or configured to generate visual data based at least partially on visual signals collected by the at least one visual data collection device; and at least one computer associated with the at least one locomotive or the at least one railcar that is programmed or configured to: process at least a portion of the visual data; and at least partially based upon the processing, determine at least one parameter associated with movement of at least a portion of the train.

In one preferred and non-limiting embodiment or aspect, the processing step comprises: separating the visual data into a plurality of discrete sequential frames; detecting at least one feature in in at least two of the plurality of discrete sequential frames; and based at least partially on a change in the position of the at least one feature in the at least two of the plurality of discrete sequential frames, generating movement data. In another preferred and non-limiting embodiment or aspect, the at least one feature comprises at least one rail tie. In another preferred and non-limiting embodiment or aspect, the system further comprises: converting the at least two discrete sequential frames into a high contrast image; processing the high contrast image to determine edge data associated with the at least one feature; and determining movement data based at least partially on a comparison of at least a portion of the edge data. In another preferred and non-limiting embodiment or aspect, the at least one visual data collection device is positioned on or associated with at least one end-of-train device.

In one preferred and non-limiting embodiment or aspect, provided is a parking verification method for a train having a braking a system, at least one locomotive, and at least one railcar, wherein the at least one locomotive and/or the at least one railcar is equipped with at least one manually-operated parking assembly, the method comprising: (a) when the train is not moving, generating braking system test data related to at least one braking system parameter; (b) based at least partially on the braking system test data: (i) generating alarm data or (ii) initiating a non-parked mode for the train; (c) after initiating non-parked mode and movement of the train, determining whether the train has subsequently stopped moving; and (d) repeating steps (a) and (b).

In one preferred and non-limiting embodiment or aspect, provided is a parking verification method for a train having a braking system, at least one locomotive, and at least one railcar, wherein the at least one locomotive and/or the at least one railcar is equipped with at least one manually-operated parking assembly, the method comprising: (a) initiating a parking verification process; (b) determining or receiving train data; (c) verifying at least one train parameter; (d) generating at least one prompt to activate at least one manually-operated parking assembly of at least one locomotive and/or at least one railcar; and (e) based upon operator input related to the at least one prompt, generating at least one prompt to activate or deactivate at least one component of the braking system.

In one preferred and non-limiting embodiment or aspect, provided is a parked train monitoring method for a train having a braking a system, at least one locomotive, and at least one railcar, wherein the at least one locomotive and/or the at least one railcar is equipped with at least one manually-operated parking assembly, the method comprising: (a) when the train is not moving, determining or detecting at least one of the following: (i) the length of time that the train has not moved, (ii) the length of time that at least one component of the braking system has been activated, (iii) whether a specified process or procedure has been initiated or completed, or any combination thereof; and (b) based at least partially on the determination or detection, generating alarm data.

In one preferred and non-limiting embodiment or aspect, provided is a movement detection method for a train having at least one locomotive and at least one railcar, comprising: generating visual data based at least partially on visual signals collected by at least one visual data collection device; and processing at least a portion of the visual data; and at least partially based upon the processing, determining at least one parameter associated with movement of at least a portion of the train.

Various further preferred and non-limiting embodiments or aspects are included as set forth in the following numbered clauses:

Clause 1: A parking verification system for a train having a braking a system, at least one locomotive, and at least one railcar, wherein the at least one locomotive and/or the at least one railcar is equipped with at least one manually-operated parking assembly, the system comprising: at least one on-board computer associated with the train and programmed or configured to: (a) when the train is not moving, generate braking system test data related to at least one braking system parameter; (b) based at least partially on the braking system test data: (i) generate alarm data or (ii) initiate a non-parked mode for the train; (c) after initiating non-parked mode and movement of the train, determine whether the train has subsequently stopped moving; and (d) repeat steps (a) and (b).

Clause 2. The parking verification system of clause 1, further comprising at least one operator interface programmed or configured to receive operator input.

Clause 3. The parking verification system of clause 2, wherein the on-board computer is further programmed or configured to generate at least one query requesting the input of train data.

Clause 4. The parking verification system of clause 3, wherein the train data comprises at least one of the following: operator name, operator identification, identification data, contact data, locomotive data, consist data, railcar data, location data, weight data, speed data, time data, grade data, payload data, braking system data, or any combination thereof.

Clause 5. The parking verification system of any of clauses 2-4, wherein the on-board computer is further programmed or configured to generate at least one query requesting the input of braking system data.

Clause 6. The parking verification system of clause 5, wherein the braking system test data is at least partially based on at least a portion of the braking system data.

Clause 7. The parking verification system of any of clauses 2-6, wherein at least a portion of the alarm data is visually displayed on the at least one operator interface.

Clause 8. The parking verification system of any of clauses 1-7, wherein the alarm data comprises at least one of the following: visual data, aural data, tactile data, braking system test data, braking system data, train data, braking system parameter data, or any combination thereof.

Clause 9. A parking verification system for a train having a braking system, at least one locomotive, and at least one railcar, wherein the at least one locomotive and/or the at least one railcar is equipped with at least one manually-operated parking assembly, the system comprising: at least one on-board computer associated with the train and programmed or configured to: (a) initiate a parking verification process; (b) determine or receive train data; (c) verify at least one train parameter; (d) generate at least one prompt to activate at least one manually-operated parking assembly of at least one locomotive and/or at least one railcar; and (e) based upon operator input related to the at least one prompt, generate at least one prompt to activate or deactivate at least one component of the braking system.

Clause 10. The parking verification system of clause 9, wherein the train data comprises at least one of the following: operator name, operator identification, identification data, contact data, locomotive data, consist data, railcar data, location data, weight data, speed data, time data, grade data, payload data, braking system data, or any combination thereof.

Clause 11. The parking verification system of clause 9 or 10, wherein the at least one train parameter comprises at least one of the following: locomotive data, braking system parameter data, or any combination thereof.

Clause 12. The parking verification system of clause 11, wherein step (c) further comprises: (c)(1) verification that the speed of the at least one locomotive is zero; (c)(2) verification that brake pipe pressure has been reduced; and (c)(3) verification that locomotive cylinder pressure has been applied.

Clause 13. The parking verification system of any of clauses 9-12, wherein step (d) further comprises determining, by the at least one on-board computer, specific locomotives and/or specific railcars on which the manually-operated braking assembly should be activated.

Clause 14. The parking verification system of clause 13, wherein the determination is at least partially based upon the grade of the track upon which the train is parked.

Clause 15. The parking verification system of any of clauses 9-14, wherein, prior to step (e), the at least one on-board computer is further programmed or configured to wait for a specified period of time.

Clause 16. The parking verification system of clause 15, wherein the specified period of time is at least partially based upon at least one of the following: a number of manually-operated braking assemblies to be activated, a position of at least one manually-operated braking assembly to be activated, train data, track data, environment data, weather data, or any combination thereof.

Clause 17. The parking verification system of any of clauses 9-16, wherein the at least one on-board computer is further programmed or configured to verify the activation or deactivation of the at least one component of the braking system.

Clause 18. The parking verification system of any of clauses 9-17, wherein the at least one on-board computer is further programmed or configured to: (f) generate at least one prompt to activate at least one throttle control component; (g) verify that the at least one throttle control component has been activated; and (h) determine whether the train has moved in response to the activation of the throttle control component.

Clause 19. The parking verification system of clause 18, wherein step (f) comprises at least one prompt to activate the at least one throttle control component to cause the train to move in at least one of a forward direction and a reverse direction.

Clause 20. The parking verification system of clause 19, wherein the at least one prompt further comprises an instruction to continue activating the at least one throttle control component for a specified period of time.

Clause 21. The parking verification system of any of clauses 18-20, wherein step (g) comprises at least one of the following: (i) receiving feedback from at least one component of the train; (ii) receiving feedback from at least one sensor of the train; or any combination thereof.

Clause 22. The parking verification system of any of clauses 18-21, wherein step (h) comprises at least one of the following: (i) determining movement data at least partially based upon feedback from at least one component of the train; (ii) determining movement data at least partially based upon feedback from at least one sensor of the train; (iii) determining movement data at least partially based upon determined or sensed motor current; (iv) determining movement data at least partially based upon user input; or any combination thereof.

Clause 23. The parking verification system of any of clauses 9-22, wherein the at least one on-board computer is programmed or configured to enter at least one parked mode.

Clause 24. The parking verification system of clause 23, wherein the at least one on-board computer is programmed or configured to: (i) terminate the at least one parked mode; and (ii) communicate or cause the communication of at least one message that the at least one parked mode has been or will be terminated.

Clause 25. The parking verification system of clause 24, wherein the at least one on-board computer is programmed or configured to communicate or cause the communication of at least one message to activate or deactivate at least one component of the braking system or at least one manually-operated braking assembly.

Clause 26. The parking verification system of any of clauses 9-25, wherein at least one step of a procedure directed to or associated with parking verification process is stored in at least one database.

Clause 27. The parking verification system of any of clauses 9-26, wherein, while the train is parked, the at least one on-board computer is further programmed or configured to: determine or detect whether the train is moving; and if train movement is determined or detected, generate alarm data.

Clause 28. The parking verification system of clause 27, wherein the determination or detection of movement comprises at least one of the following: sensing or determining rotation or movement of an independent rotating structure; sensing or determining movement of at least one railcar; sensing or determining movement of at least one end-of-train device; collecting and processing visual data; collecting and processing radar data; collecting and processing position data; collecting and processing accelerometer data; or any combination thereof.

Clause 29. The parking verification system of any of clauses 9-28, wherein, while the train is parked, at least one computer is programmed or configured to determine or detect at least one of the following: (i) activation of or interaction with at least one throttle control component; (ii) operation of or interaction with at least one manual release rod; (iii) operation of or interaction with at least one hand brake arrangement; (iv) operation of or interaction with at least one component of the braking system; (v) operation of or interaction with at least one component of a manifold; (vi) operation of or interaction with at least one actuator; (vii) a pressure change in at least one component of the braking system; (viii) a pressure drop in at least one component of the braking system; or any combination thereof.

Clause 30. The parking verification system of any of clauses 9-29, wherein, while the train is parked, the at least one on-board computer is programmed or configured to: determine or detect activation of or interaction with at least one component of the braking system or the manually-operated parking assembly; and if activation or interaction is determined or detected, generate alarm data.

Clause 31. The parking verification system of any of clauses 9-30, wherein, while the train is parked, the at least one on-board computer is programmed or configured to: determine or detect a change in at least one braking system parameter; and if change is determined or detected, generate alarm data.

Clause 32. A parked train monitoring system for a train having a braking a system, at least one locomotive, and at least one railcar, wherein the at least one locomotive and/or the at least one railcar is equipped with at least one manually-operated parking assembly, the system comprising: at least one on-board computer associated with the train and programmed or configured to: (a) when the train is not moving, determine or detect at least one of the following: (i) the length of time that the train has not moved, (ii) the length of time that at least one component of the braking system has been activated, (iii) whether a specified process or procedure has been initiated or completed, or any combination thereof; and (b) based at least partially on the determination or detection, generate alarm data.

Clause 33. The parked train monitor system of clause 32, wherein, based at least partially on at least a portion of the alarm data, the at least one on-board computer is programmed or configured to implement or cause at least one of the following: an audible alarm in the at least one locomotive; activation of a horn or bell of the train; powering of at least one light associated with the train; communication of at least one message to at least one user; communication of at least one message to a remote server; or any combination thereof.

Clause 34. A movement detection system for a train having at least one locomotive and at least one railcar, comprising: at least one visual data collection device programmed or configured to generate visual data based at least partially on visual signals collected by the at least one visual data collection device; and at least one computer associated with the at least one locomotive or the at least one railcar that is programmed or configured to: process at least a portion of the visual data; and at least partially based upon the processing, determine at least one parameter associated with movement of at least a portion of the train.

Clause 35. The movement detection system of clause 34, wherein the processing step comprises: separating the visual data into a plurality of discrete sequential frames; detecting at least one feature in in at least two of the plurality of discrete sequential frames; and based at least partially on a change in the position of the at least one feature in the at least two of the plurality of discrete sequential frames, generating movement data.

Clause 36. The movement detection system of clause 35, wherein the at least one feature comprises at least one rail tie.

Clause 37. The movement detection system of clause 35 or 36, further comprising: converting the at least two discrete sequential frames into a high contrast image; processing the high contrast image to determine edge data associated with the at least one feature; and determining movement data based at least partially on a comparison of at least a portion of the edge data.

Clause 38. The movement detection system of any of clauses 34-37, wherein the at least one visual data collection device is positioned on or associated with at least one end-of-train device.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
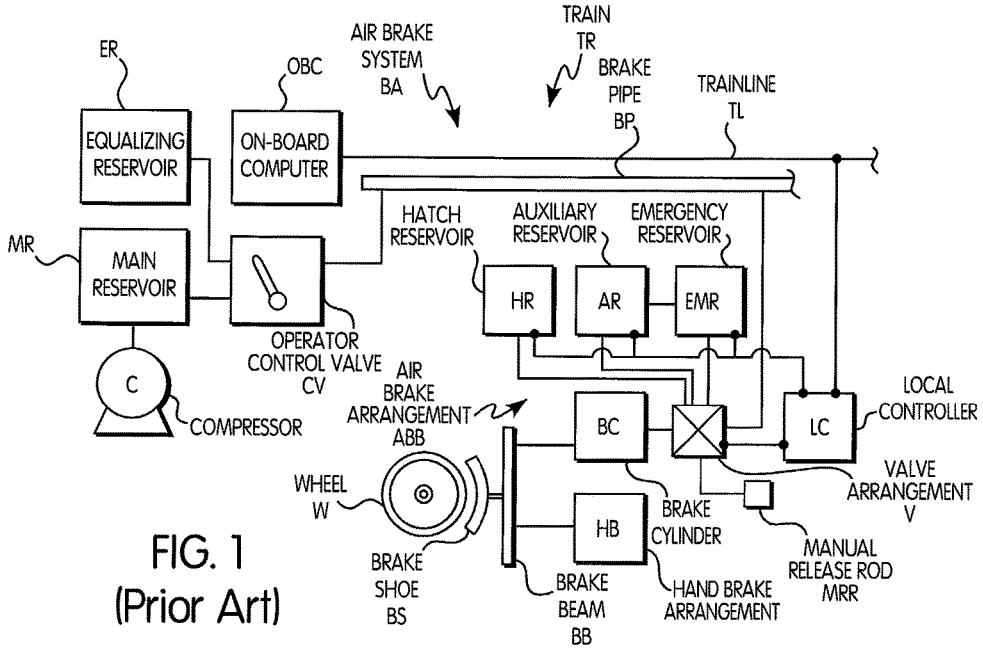
FIG. 1 (Prior Art)
FIG. 1 is a schematic view of an air brake system for use on a train in accordance with the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The navigation system and computer-implemented communication method described and claimed herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars that make up a train (TR), such as a train (TR) in a "push-pull" arrangement. It should be noted that multiple locomotives or control cars may be included in the train (TR) to facilitate the reduction of the train (TR) to match with passenger (or some other) demand or requirement. Further, the method and systems described herein can be used in connection with commuter trains, freight train, and/or other train arrangements and systems.

Figure 2:
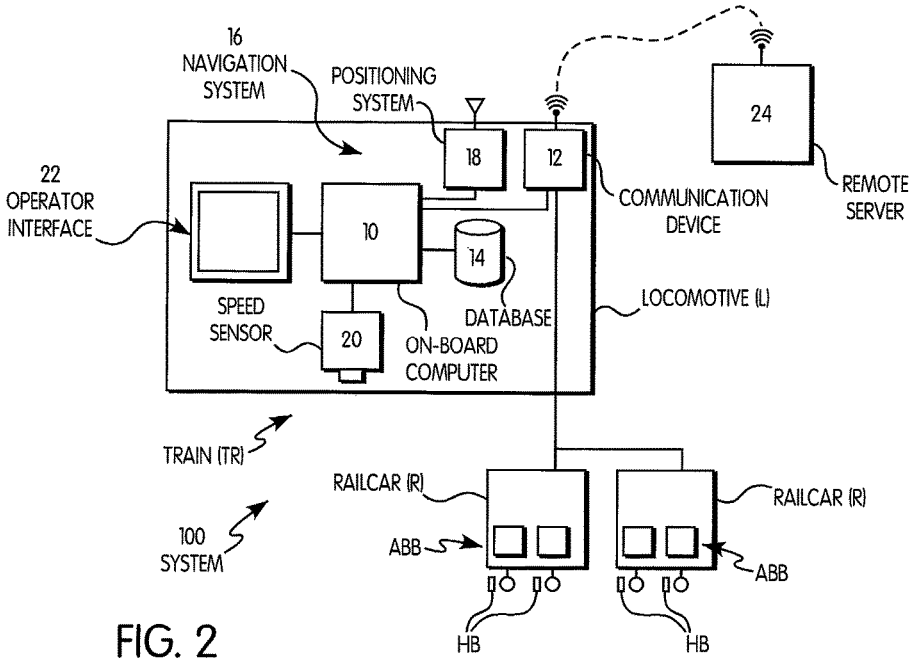
FIG. 2 is a schematic view of a train parking or movement verification and monitoring system according to the principles of the present invention.

Accordingly, and in one preferred and non-limiting embodiment or aspect, and as illustrated in FIG. 2, the system architecture used to support the functionality of at least some of the methods and systems described herein includes a train management computer or on-board computer 10 (which performs calculations for or within the Positive Train Control (PTC) system, including navigation calculations and is typically located in one or more of the locomotives or control cars (L)), a communication device 12 or data radio (which may be used to facilitate the communications between the on-board computers 10 in one or more of the locomotives or control cars (L) of a train (TR), communications with a wayside device, e.g., signals, switch monitors, and the like, and/or communications with a remote server, e.g., a back office server, a central controller, central dispatch, and/or), at least one database 14 (which may include information about the train or its operating parameters, track positions or locations, switch locations, track heading changes, e.g., curves, distance measurements, train information, e.g., the number of locomotives, the number of cars, the number of conventional passenger cars, the number of control cars, the total length of the train, the specific identification numbers of each locomotive or control car (L) where PTC equipment (e.g., an on-board computer 10) is located, and the like), and a navigation system 16 (optionally including a positioning system 18 (e.g., a Global Positioning System (GPS)) and/or a wheel tachometer/speed sensor 20). In addition, an operator interface 22 (e.g., an interactive display, a computer screen, a computer monitor, a display in communication with an input device, a display device, a display mechanism, and the like) is provided and in direct or indirect communication with the on-board computer 10 for displaying information and data to the operator/user. With continued reference to the embodiment or aspect of FIG. 2, and as discussed above, the locomotive or control car (L) is communication with the railcars (R) over the Trainline (TL) and/or through wireless communication. As further discussed, some or all of the railcars (R) are equipped with an air brake arrangement (ABB), which includes a hand brake arrangement (HB).

As illustrated in schematic form in FIG. 2, and according to one preferred and non-limiting embodiment or aspect, provided is a parking verification system 100 for a train (TR) having a braking system, e.g., air brake system (BA), at least one locomotive or control car (L), and at least one railcar (R). The at least one locomotive or control car (L) and/or the at least one railcar (R) is equipped with at least one manually-operated parking assembly, e.g., the above-discussed hand brake arrangement (HB). The system further includes at least one on-board computer 10 associated with the train (TR), and, in this embodiment or aspect and when the train (TR) is not moving (e.g., after the operator applies the air brake arrangements (ABB) on the locomotive (L) and railcars (R)), the on-board computer 10 is programmed or configure to: (a) generate braking system test data related to at least one braking system parameter; (b) based at least partially on the braking system test data: (i) generate alarm data or (ii) initiate a non-parked mode for the train (TR); and (c) after initiating this non-parked mode and movement of the train, determine whether the train (TR) has subsequently stopped moving; and (d) repeat steps (a) and (b).

In a preferred and non-limiting embodiment or aspect, the operator/user, e.g., the crew, interacts with the operator interface 22 (which is controlled by the on-board computer 10), which is programmed or configured to receive operator input. The operator may initiate the parking verification method, process, or procedure using operator interface 22. In this embodiment or aspect, the on-board computer is further programmed or configured to generate at least one query requesting the input of train data. For example, the train data includes at least one of the following: operator name, operator identification, identification data (e.g., an electronic identification card, such as those described in U.S. Pat. No. 5,816,541 (which is incorporated herein by reference)), contact data (e.g., cell phone information), locomotive data (e.g., the number of locomotives or control cars (L) in the consist), consist data, railcar data (e.g., the number of railcars (R) in the train (TR), location data (e.g., milepost location), weight data, speed data (e.g., locomotive (L) speed, end-of-train device speed, verification that the speed is zero, and the like), time data (e.g., the approximate number of hours the train (TR) is expected to remain parked), grade data (e.g., the approximate grade of the track), payload data (e.g., hazardous materials, etc.), braking system data (e.g., brake pipe (BP) pressure, locomotive brake cylinder pressure, etc.), or any combination thereof. Further, it is recognized that at least a portion of these data points can be automatically generated or determined by the on-board computer 10, e.g., sensing that the speed of the locomotive (L) and/or the end-of-train device is zero, determining that the brake pipe (BP) pressure has been reduced, such that the air brake arrangements (ABB) are applied, and/or determining that the locomotive brake cylinder pressure is applied.

In another preferred and non-limiting embodiment or aspect, the on-board computer 10 is further programmed or configured to generate at least one query requesting the input of braking system data, and the braking system test data may be at least partially based on at least a portion of the braking system data. For example, the query may request a confirmation that the terminal air brake tests have been successfully complete, at which point the operator interface 22 may display a "Start Trip" message. This entire process, including the data entries and determination, may be recorded and stored in the database 14 (or transmitted to some remote server 24, e.g., central dispatch, a central controller, a wayside device, a remote computer, and the like). In addition, the on-board computer 10 may perform this confirmation process automatically and/or independently of the operator. After confirmation, the on-board computer 10 may place the train (TR) in a "Non-parked Mode". At subsequent stops, e.g., stops where railcars (R) are added (and another air brake test is required), the process is repeated and/or recorded. Further, at these intermediate stops, the on-board computer 10 can be programmed or configured to display a "Re-Start Trip" message after receiving confirmation (or independently and/or automatically determining) that the air brake test was successfully completed.

If it is determined from the air brake data (whether sensed, determined, or input) that the appropriate air brake test has not been completed, or has been completed but indicates a problem or fault is present, the on-board computer 10 may generate alarm data. Similarly, if the operator does not respond to the query for a specified period of time, or with improper input, such alarm data will be generated. This alarm data is used to generate an alarm to the operator and/or crew, and in one-preferred and non-limiting embodiment or aspect, the train (TR) will be prevented from moving. In this embodiment or aspect, at least a portion of the alarm data is visually displayed on the operator interface 22. Further, this alarm data be in the form of or include at least one of the following: visual data, aural data, tactile data, braking system test data, braking system data, train data, braking system parameter data, or any combination thereof.

In another preferred and non-limiting embodiment or aspect, the parking verification system 100 includes the on-board computer 10, which is programmed or configured to: (a) initiate a parking verification process; (b) determine or receive train data; (c) verify at least one train parameter; (d) generate at least one prompt to activate at least one manually-operated parking assembly of at least one locomotive (L) and/or at least one railcar (R); and (e) based upon operator input related to the at least one prompt, generate at least one prompt to activate or deactivate at least one component of the braking system.

In this embodiment or aspect, the operator may have applied or activated the air brake system (BA) and brought the train (TR) to a stop. At that point, the verification process is initiated (and, as discussed above, optionally recorded and/or stored in the database 14 or at the remote server 24). As discussed, the train data may include at least one of the following: operator name, operator identification, identification data, contact data, locomotive data, consist data, railcar data, location data, weight data, speed data, time data, grade data, payload data, braking system data, or any combination thereof. Further, the at least one train parameter may include or be in the form of at least one of the following: locomotive data (e.g., data or information related to or associated with the locomotive or control car (L), braking system parameter data (e.g., data or information related to or associated with any component of the air brake system (BA)), or any combination thereof. This train data may be automatically determined, selected from data in the database 14, input by the operator at the operator interface 22, received from the remote server 24, and/or the like.

In another preferred and non-limiting embodiment or aspect, the train parameter verification step includes one or more of the following: verification that the speed of the locomotive (L) is zero; verification that brake pipe pressure has been reduced (indicating that the air brake system (BA) has been activated; and/or verification that the locomotive brake cylinder pressure has been applied. These verifications can be accomplished in an automated process, e.g., a process using sensors or other feedback devices, by the on-board computer 10.

In another preferred and non-limiting embodiment or aspect, the on-board computer 10 is programmed or configured to determine specific locomotives (L) and/or specific railcars (R) on which the hand brake arrangement (HB), e.g., the manually-operated braking assembly, should be activated. This determination can be used to generate a message for display on the operator interface 22. For example, the message may instruct the operator to apply the hand brake arrangement (HB) on each locomotive (L) and ever X railcar (R), where X is dependent upon the grade data for the track upon which the train (TR) is parked.

In another preferred and non-limiting embodiment or aspect, and prior to prompting the operator activate or deactivate a component of the air brake system (BA), the one on-board computer 10 is further programmed or configured to wait for a specified period of time, and this specified period of time may at least partially be based upon at least one of the following: a number of hand brake arrangements (HB) to be activated, a position of at least one hand brake arrangement (HB) to be activated, train data, track data, environment data, weather data, or any combination thereof. For example, the on-board computer 10 may lock-out the operator or somehow prevent further operations for a specified period of time that is at least partially based upon an estimate of the time it should take to activate the specified hand brake arrangements (HB) on the specified locomotives (L) and/or railcars (R). This eliminates any perceived benefit of avoiding setting all of the required hand brake arrangements (HB) to "save time" in the parking process. Further, a countdown may be displayed to the operator during the waiting period, e.g., "Waiting XX seconds while hand brakes are being applied," "Locked for XX seconds while X hand brakes are being applied," or the like. After the specified period of time, the on-board computer 10 may generate a query to the operator asking whether all of the specified hand brake arrangements (HB) have been applied. Once the operator has confirmed proper application, the on-board computer 10 may generate a prompt to the operator to activate or deactivate one or more components of the air brake system (BA), e.g., "You may now release the air brakes."

In another preferred and non-limiting embodiment or aspect, the on-board computer 10 is further programmed or configured to verify the activation or deactivation of the at least one component of the braking system. For example, and preferably using sensors or other feedback devices or arrangements, the on-board computer 10 can verify whether the air brake system (BA) has been deactivated or released, e.g., by determining or sensing the pressures in the brake pipe (BP), locomotive brake cylinder, end-of-train device brake pipe, and/or the like.

In a further preferred and non-limiting embodiment or aspect, the on-board computer 10 is further programmed or configured to: generate at least one prompt to activate at least one throttle control component; verify that the at least one throttle control component has been activated; and determine whether the train (TR) has moved in response to the activation of the throttle control component. Such a test or process may be referred to as a "push-pull test" or "simulated wind nudge test." In one preferred and non-limiting embodiment or aspect, the prompt to the operator may be a message to activate the at least one throttle control component to cause the train (TR) to move in at least one of a forward direction and a reverse direction, may further indicate that the operator should continue activating the at least one throttle control component for a specified period of time. For example, the message may request that the operator move the throttle to a first position for X seconds, after which, the on-board computer 10 is programmed or configured to verify that the throttle was in the first position (in a non-neutral direction, i.e., in a forward or reverse direction) for X seconds, and that no motion has occurred. The on-board computer 10 may also be programmed to verify that a minimum amount of motor current was also detected or sensed. Accordingly, the verification process may include receiving feedback from at least one component of the train (TR) and/or receiving feedback from at least one sensor of the train (TR).

In another preferred and non-limiting embodiment or aspect, the verification process includes at least one of the following: (i) determining movement data at least partially based upon feedback from at least one component of the train (TR); (ii) determining movement data at least partially based upon feedback from at least one sensor of the train (TR); (iii) determining movement data at least partially based upon determined or sensed motor current; (iv) determining movement data at least partially based upon user input, e.g., displaying a message to the operator to confirm that no motion has occurred in response to activation of the throttle component; or any combination thereof. Still further, the on-board computer 10 may be programmed or configured to generate a message to the operator to move into a position that is opposite the previous throttle position, i.e., from forward to reverse or from reverse to forward, for a specified period of time. The same automatic or manual feedback information, i.e., movement data, is again determined to ensure that the train (TR) has not moved. Still further, a message may be then generated asking that the operator move the throttle back to the idle position, and the reverser back to neutral. Optionally, a message may indicate to the operator to reapply the air brake system (BA). It should also be recognized that any feedback (whether automatic or manually entered) that indicates movement may lead to additional steps to ensure that the hand brake arrangements (HB) have been properly applied, or require additional attention or maintenance.

Once complete, the on-board computer 10 is programmed or configured to enter at least one parked mode. Entry into the "parked mode" may be displayed on the operator interface 22, and the operator can confirm this message. After confirmation, a message can be displayed indicating additional details about the parked mode, e.g., "This locomotive is in PARKED mode by John Smith at 11:25 PM on 7/5/2015, and his cell phone number is 555-1212. BEFORE ANYONE RELEASES THE AIR BRAKES ON THIS TRAIN, PLEASE PRESS HERE." When the train (TR) is ready to again be moved, the operator must terminate the parked mode. When activating (or attempting to activate or move) the train (TR), a message may be transmitted to the listed operator, to the remote server 24, to some other control user, stored in the database 14, and/or the like. Further, after the parking procedure has been terminated, the on-board computer 10 is programmed or configured to generate and display messages relating to the release of the applied hand brake arrangements (HB) and/or recharge the brake pipe (BP). As discussed above, some or all of these steps in the process can be monitored, logged, recorded, and/or communicated to any computer or user in the system.

In one preferred and non-limiting embodiment or aspect, the on-board computer 10 is programmed or configured to: (i) terminate the at least one parked mode; and (ii) communicate or cause the communication of a message that the parked mode has been or will be terminated. As discussed, this communication or message may be implemented with respect to the operator interface 22, recorded or logged to the database 14, and/or transmitted to the remote server 24. In addition, the on-board computer 10 may be programmed or configured to communicate or cause the communication of a message to activate or deactivate at least one component of the air brake system (BA) or at least one hand brake arrangement (HB). As discussed, any of the steps of the process or procedure directed to or associated with parking verification process may be stored in the database 14.

As is recognized, an unattended train (TR) is more dangerous than a train controlled by or operated by an operator. Accordingly, and when the operator leaves the train unattended, the on-board computer 10 may be programmed or configured to implement additional monitoring actions. Accordingly, and in one preferred and non-limiting embodiment or aspect, while the train (TR) is parked (or in parked mode), the on-board computer 10 is programmed or configured to: determine or detect whether the train (TR) is moving; and if train (TR) movement is determined or detected, generate alarm data. This alarm data may be communicated to the operator interface 22 in the locomotive or control car (L) and/or transmitted to the remote server 24 (or some other wayside or remote device or system). Further, the determination or detection of movement may include one or more of the following: sensing or determining rotation or movement of an independent rotating structure; sensing or determining movement of at least one railcar (R); sensing or determining movement of at least one end-of-train device; collecting and processing visual data; collecting and processing radar data; collecting and processing position data; collecting and processing accelerometer data; or any combination thereof. For example, and while the train (TR) is parked, and if movement (e.g., a non-zero speed) of the train (TR) is detected or determined, an alarm is initiated, and the brake pipe (BP) is vented to initiate an emergency brake application. As discussed, this non-zero speed may be detected at the front of the train (TR), e.g., at the locomotive (L), or at the back of the train (TR), e.g., at the end-of-train device.

As discussed, if movement or motion is detected while the train (TR) is parked, whether before or after the generation of the alarm data, an emergency brake application may be implemented, such as by venting the brake pipe (BP) at the locomotive (L), at the end-of-train device (i.e., the last railcar (R)), and/or at both ends of the train (TR) (e.g., at the locomotive (L) and the last railcar (R) (which may occur through communication with the end-of-train device)). As also discussed above, the motion or movement of the train (TR) may be detected by or at the locomotive (L), by or at the end-of-train device, and/or by or at the equipment (e.g., a component of the electronically-controlled pneumatic (ECP) air brake arrangement) on any of the railcars (R). After detection, and in one preferred and non-limiting embodiment or aspect, the on-board computer 10, the end-of-train device, and/or the local controller (LC) may determine that the train (TR) is a "runaway" train, at which point an emergency brake application can be implemented.

In one preferred and non-limiting embodiment or aspect, if the on-board computer 10 determines or receives information that the train (TR) is in motion or is moving when it should be parked, the on-board computer 10 may cause an emergency brake application at the locomotive (L) by quickly venting the brake pipe (BP), and at the same time, communicate with the end-of-train device to cause an emergency brake application at the last railcar (R) by venting the brake pipe (BP) at the end-of-train location. In addition, and in another preferred and non-limiting embodiment or aspect, when the train (TR) is placed or identified as being in parked mode, the end-of-train device will be notified as such.

Accordingly, the end-of-train device may also determine or receive information that the train (TR) is in motion or is moving when it should be parked, the end-of-train device may cause an emergency brake application at the last railcar (R) by quickly venting the brake pipe (BP), and at the same time, communication with the on-board computer 10 to cause an emergency brake application at the locomotive (L) by venting the brake pipe (BP) at the head-of-train location.

In another preferred and non-limiting embodiment or aspect, and while the train (TR) is parked, the on-board computer 10 is programmed or configured to: determine or detect activation of or interaction with at least one throttle control component; and if activation or interaction is determined or detected, generate alarm data. Specifically, if a person attempts to move the train by activating or actuating the throttle handle or the reverser handle before terminating the required parking procedure, the system may initiate an alarm sequence and/or initiate an emergency braking action. Similarly, and in another preferred and non-limiting embodiment or aspect, and while the train (TR) is parked, the on-board computer 10 is programmed or configured to: determine or detect activation of or interaction with at least one component of the air brake system (BA) or a hand brake arrangement (HB); and if activation or interaction is determined or detected, generate alarm data. Therefore, if a person releases the train brakes or the independent brake in the locomotive (L) without terminating the required parking procedure, the system may initiate an alarm sequence and/or initiate an emergency braking action. Still further, in a further preferred and non-limiting embodiment or aspect, and while the train is parked, the on-board computer 10 is programmed or configured to: determine or detect a change in at least one braking system parameter; and if change is determined or detected, generate alarm data. For example, if the pressure in the brake pipe (BP) increases or decreases suddenly (which is a possible indication of tampering or some other failure), the system may initiate an alarm sequence and/or initiate an emergency braking action. The pressure that is monitored may include the brake cylinder in the locomotive (L), the brake pipe (BP) near the front of the train (TR), and/or the brake pipe (BP) near the rear of the train (TR). In addition, this alarm sequence and/or emergency braking action may be triggered by the sensing or determination that one or more of the angle cocks have been tampered with.

In a further preferred and non-limiting embodiment or aspect, the on-board computer 10 is programmed or configured to: (a) when the train (TR) is not moving, determine or detect at least one of the following: (i) the length of time that the train (TR) has not moved, (ii) the length of time that at least one component of the air brake system (BA) has been activated, (iii) whether a specified process or procedure has been initiated or completed, or any combination thereof; and (b) based at least partially on the determination or detection, generate alarm data. For example, after a train (TR) has started a trip and placed in the un-parked mode, the on-board computer 10 enters a monitoring mode. Accordingly, if a train (TR) is left with the air brake system (BA) active for a specified period of time, e.g, about 1 to about 4 hours, and the parking procedure was not initiated, an alarm sequence may be implemented. The stop time of the train (TR) may be determined by monitoring a brake application followed by no movement, i.e., zero speed. This non-zero speed may initiate a stopped-train timer, and when the stopped-train timer exceed a specified set point, the alarm sequence will be initiated.

In one preferred and non-limiting embodiment or aspect, and based at least partially on at least a portion of the alarm data, the one on-board computer 10 is programmed or configured to implement or cause at least one of the following: an audible alarm in the at least one locomotive (L); activation of a horn or bell of the train (TR); powering of at least one light associated with the train (TR); communication of at least one message to at least one user; communication of at least one message to the remote server 24; or any combination thereof. For example, the alarm sequence may include initiating a call or text to a cellular phone, initiating an email to a person, such as the operator, initiating a message to a remote server 24, initiating a message to a wayside device, e.g., in a manner similar to the hot box detector. Further, a message may be sent to the ATCS or ETMS.

In another preferred and non-limiting embodiment or aspect, and as discussed, the on-board computer 10 will maintain or log (in the database 14 or at the remote server 24) an electronic record of the parking procedure, and these records may be evaluated periodically. It is envisioned that these records may be used in addressing any issues with operators that have not followed the required procedures.

Figure 3:
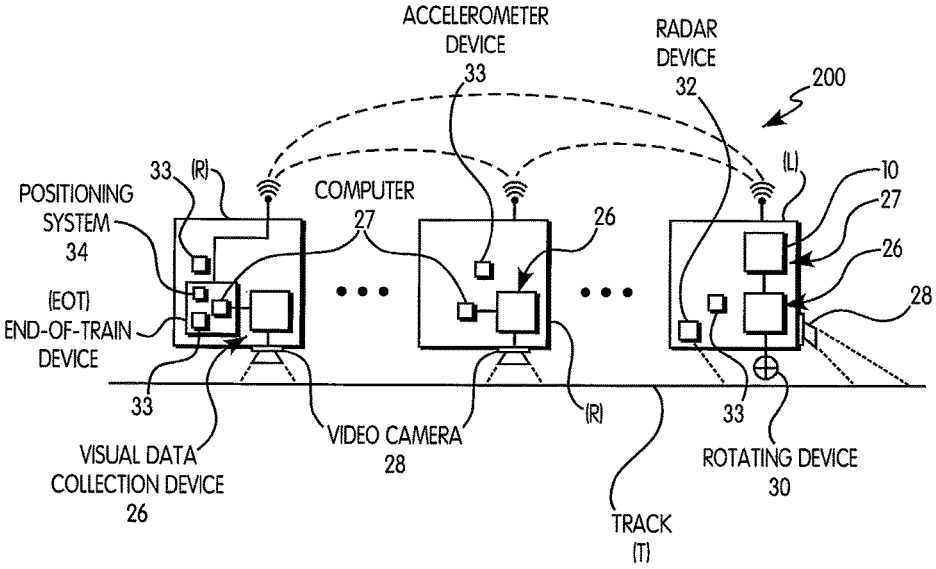
FIG. 3 is a schematic view of a movement or motion detection system according to the principles of the present invention.

In another preferred and non-limiting embodiment or aspect, and as illustrated in FIG. 3, provided is a movement (or motion) detection system 200 for a train (TR) having at least one locomotive (L) and at least one railcar (R). In this embodiment or aspect, the system 200 includes at least one visual data collection device 26 programmed or configured to generate visual data based at least partially on visual signals collected or obtained by the visual data collection device 26 (which may be positioned on or associated with the at least one locomotive (L) or the at least one railcar (R)). The system 200 further includes at least one computer 27 associated with the at least one locomotive (L) or the at least one railcar (R) that is programmed or configured to: process at least a portion of the visual data; and, at least partially based upon the processing, determine at least one parameter associated with movement of at least a portion of the train (TR). The computer 27 may be in the form of the above-discussed on-board computer 10, a computer positioned on or associated with one or more of the railcars (R), a computer positioned on or associated with electronically-controlled pneumatic braking equipment (such as the local controller (LC)), a computer programmed or configured to communicate wirelessly and/or over the Trainline (TL), and/or a computer associated or integrated with an end-of-train device (EOT). While it is recognized that the speed sensor 20 and/or axle tachometer connected to a locomotive wheel can be sensed, if that wheel has the hand brake arrangement (HB) engaged, zero angular speed may be sensed even if the train (TR) is moving with the wheels locked. Therefore, this system 200 may be designed to determine movement separate and apart from the existing speed sensor 20.

In one preferred and non-limiting embodiment or aspect, the visual data collection device 26 is in direct or indirect communication with (or includes or is integrated with) at least one video camera 28. This video camera may be positioned or oriented towards the track (T), e.g., the rail ties of the track (T), such that a count of the rail ties can be determined, or train movement otherwise detected. Similarly, a video camera or recording device that is already positioned on the train (TR), e.g., a video recorder associated with the end-of-train device (EOT) can be positioned or oriented to achieve this function, or alternatively, programmed or configured to collect the desired visual data. For example, the video camera 28 (or the visual data collection device 26) may also be programmed or configured to collect data regarding or used to sense train motion, as opposed to objects in its field-of-vision.

In another preferred and non-limiting embodiment or aspect, one or more rotating devices 30, such as a bicycle wheel riding on a rail of the track (T) and fitted with a tachometer to sense or determine movement, is provided, which also represents an improved method of calibrating train speed independent of wheel slip/slide. In another preferred and non-limiting embodiment or aspect, the system 200 includes one or more radar devices 32 that may be positioned or oriented with respect to the rail ties, e.g., at an angle with respect thereto, such that the motion can be detected at least partially based on the radar signals. Still further, the train movement or motion may be detected based upon determinations or data derived from a positioning system 34, such as a positioning system 34 (e.g., a GPS device) associated or integrated with the end-of-train device (EOT). The sensed, raw, and/or processed data from any of these devices, e.g., rotating device 30, radar device 32, positioning system 34, and the like, may be transmitted, directly or indirectly, to the at least one computer 27, which may be in the form of the above-discussed on-board computer 10, a computer positioned on or associated with one or more of the railcars (R), a computer positioned on or associated with electronically-controlled pneumatic braking equipment (such as the local controller (LC)), a computer programmed or configured to communicate wirelessly and/or over the Trainline (TL), and/or a computer associated or integrated with an end-of-train device (EOT).

In a still further preferred and non-limiting embodiment or aspect, one or more accelerometer devices 33 can be positioned on or associated with the at least one locomotive (L) and/or the at least one railcar (R), or any of the equipment or systems positioned thereon or associated therewith. The accelerometer data may be transmitted, directly or indirectly, to the at least one computer 27, which may be in the form of the above-discussed on-board computer 10, a computer positioned on or associated with one or more of the railcars (R), a computer positioned on or associated with electronically-controlled pneumatic braking equipment (such as the local controller (LC)), a computer programmed or configured to communicate wirelessly and/or over the Trainline (TL), and/or a computer associated or integrated with an end-of-train device (EOT). This accelerometer device 33 may be in the form of a piezo-electric device, a piezo-resistive device, a capacitive device, a device that converts mechanical motion into electrical signals, a gyroscope, and the like. In one preferred and non-limiting embodiment or aspect, the accelerometer device 33 is a MEMS (micro-electromechanical system) accelerometer is used, such that the acceleration in one, two, or three axes can be measured or detected.

In another preferred and non-limiting embodiment or aspect, the accelerometer device 33 is programmed or configured to output data and information associated with all three axes. The at least one computer 27 receives and processes this output to make a determination of movement or motion of all or a portion of the train (TR), where the outputs of the accelerometer device 33 includes the horizontal axis parallel to the track, the horizontal axis perpendicular to the track, and the vertical axis. The output/signal associated with the horizontal axis parallel to the track results from a detection of a slow, steady acceleration in either direction of the track, and the output/signal on this axis would be in the form of a small, step shape (up or down) if the train brakes (whether the air brake arrangement (ABB) or the hand brake arrangements (HB)) were released and the train (TR) were to drift down a hill. The output/signal associated with the horizontal axis perpendicular to the track results from a detection any periodic acceleration data generated from the harmonic rocking of the railcar (R) as it moves along staggered rails or successive low joints. It may be recognized that the amplitude of the acceleration due to rocking is most pronounced between 13-25 miles per hour. The output/signal associated with the vertical axis may be used in detecting higher speeds, e.g., above about 50 miles per hour, since vertical signals result from the railcar (R) bouncing periodically over square joints, as opposed to staggered joints.

It should be recognized that any of these outputs/signals from the accelerometer device 33 can be used alone or in combination with the other output/signals of the accelerometer device 33. One advantage of using a MEMS accelerometer is that such accelerometer devices 33 are low in cost, have low power demands, are small in size, and can be enclosed, such as in a portion of the end-of-train device (EOT), thereby being protected from the outside environment. Another benefit of using the accelerometer device 33 is that it can also be helpful in detecting tampering or theft of the end-of-train device (EOT) (if the accelerometer device 33 is positioned on or in the end-of-train device (EOT)). If someone or something disturbs or removes the end-of-train device (EOT) from a parked train (TR) or a train (TR) in motion, then, based upon the output/signals of the accelerometer device 33, an alarm condition may be initiated.

It should be recognized that the output/signals from any of the above-discussed motion-sensing devices (e.g., the visual data collection device 26, the rotating device 30, the radar device 32, the positioning system 34, the accelerometer device 33, and the like) can be used alone or in combination with the output/signals associated with one or more other devices. In this manner, and by using more than one device or device type/technology, a redundant system can be implemented. The at least one computer 27 can receive all of these outputs/signals and determine which device or devices indicate motion or movement of all or a portion of the train (TR).

As is known, if the air brake arrangement (ABB) on a small number of railcars (R) fail to release on a train (TR) having many railcars (R) (e.g., 100 or more railcars (R)), and in order to prevent loud, hot, wheel (W) sliding on the rails of the track (T) for many miles, the AAR rules permit those specific air brake arrangements (ABB) to be "cut out". This "cut out" procedure includes turning the cut-out cock so that the brake pipe (BP) is isolated from the valve arrangement (V), then the manual release rod (MRR) is pulled on the valve arrangement (V). This process drains the brake cylinder (BC), releasing the brakes on that particular railcar (R), and further drains the auxiliary reservoir (AR). This may lead to a situation where a person may accidentally or intentionally pull the manual release rods (MRR) when the train (TR) is parked, leading to an unsafe situation. Further, by pulling the manual release rods (MRR), this may indicate that the person will also accidentally or intentionally release the hand brake arrangement (HB), which will certainly lead to an unsafe situation where the train (TR) may start to move.

In an electronically-controlled pneumatic braking-enable train (TR), the railcar (R) equipment (e.g., the local controller (LC) or the computer 27) is connected to, and maintains constant communications with, the on-board computer (OBC), typically via data communications over the trainline (TL). In one preferred and non-limiting embodiment or aspect, the accelerometer device 33 may be positioned on or associated with one or more components of the ECP systems and arrangement. Based upon the accelerometer data, if the local controller (LC) and/or the computer 27 on the railcar (R) determines that the railcar (R) is in motion, a message, a data transmission (e.g., over the Trainline (TL)), an alarm condition, or the like will be sent to the on-board computer 10, the computer 27 on the locomotive (L), or the like. The on-board computer 10 or computer 27 may then initiate an alarm or initiate any other safety or communication processes.

In another preferred and non-limiting embodiment or aspect, if a person were to tamper with the manual release rod (MRR), the local controller (LC) and/or the computer 27 on the railcar (R) may sense a significant drop in pressure in the brake cylinder (BC) and/or the auxiliary reservoir (AR). If this drop in pressure (the value of which may be configurable, predetermined, adjustable, or the like) is sensed or determined (e.g., while the train (TR) is parked), the local controller (LC) and/or the computer 27 may be programmed or configured to send a message, a data transmission (e.g., over the Trainline (TL)), an alarm condition, or the like to the on-board computer 10, the computer 27 on the locomotive (L), or the like. The on-board computer 10 or computer 27 may then initiate an alarm or initiate any other safety or communication processes. It is also envisioned that the local controller (LC) and/or the computer 27 on the railcar (R) can sense or determine that some other actuator (e.g., an actuator on an ECP manifold, a manual release pushbutton, a button or switch, or the like) has been actuated or activated. If this actuation or activation is associated with a potentially unsafe condition for the air brake arrangement (ABB) of the railcar (R), this condition or event may be communicated, such as via a message, a data transmission (e.g., over the Trainline (TL)), an alarm condition, or the like sent to the on-board computer 10, the computer 27 on the locomotive (L), or the like.

This system 200 may be used or implemented to sense and address a "runaway" train (TR), which may be caused by a "break-in-two" event. For example, if someone tampers with a train (TR) by turning off angle cocks, and decoupling the railcars (R) from the locomotive (L), and/or releasing the hand brake arrangements (HB), the system 200 could be used to detect or determine motion and/or speed, such as speed at or near the end-of-train device (EOT), and an emergency braking sequence may be implemented (e.g., via the locomotive (L) and/or via the end-of-train device (EOT)). Various alarm sequences may also be initiated.

In another preferred and non-limiting embodiment or aspect, the processing step includes: separating the visual data into a plurality of discrete sequential (video) frames; detecting at least one feature in in at least two of the plurality of discrete sequential frames; and based at least partially on a change in the position of the at least one feature in the at least two of the plurality of discrete sequential frames, generating movement data. For example, the detected features may be in the form of one or more rail ties. The system 200 may then convert the at least two discrete sequential frames into a high contrast image; process the high contrast image to determine edge data associated with the at least one feature; and determine movement data based at least partially on a comparison of at least a portion of the edge data.

In one exemplary embodiment or aspect, a video camera 28 is used and oriented in a downward facing direction. Optionally, one or more infrared lights and/or LEDs may also be projecting downwards for nighttime operations. As discussed, the speed or movement may be determined by the computer 27 that analyzes every video frame and counts the rail ties that pass its field-of-view. Assuming that the rail tie spacing is about 19.5 inches, a speed measurement may be made. At high speeds, where the rail ties are passing too quickly for effective detection/measurement, other detection features may be used. Also, and since in some embodiment or aspect only a binary determination of "motion"/"no motion", the precise speed may not be required. Also, and as discussed, the video camera 28 may be associated with or integrated with the end-of-train device (EOT), such that extra connections are not required by the installer of the end-of-train device (EOT).

In another preferred and non-limiting embodiment or aspect, provided is a parking verification method for a train having a braking system, at least one locomotive, and at least one railcar, wherein the at least one locomotive and/or the at least one railcar is equipped with at least one manually-operated parking assembly, the method comprising: (a) when the train is not moving, generating braking system test data related to at least one braking system parameter; (b) based at least partially on the braking system test data: (i) generating alarm data or (ii) initiating a non-parked mode for the train; (c) after initiating non-parked mode and movement of the train, determining whether the train has subsequently stopped moving; and (d) repeating steps (a) and (b).

In a further preferred and non-limiting embodiment or aspect, provided is a parking verification method for a train having a braking system, at least one locomotive, and at least one railcar, wherein the at least one locomotive and/or the at least one railcar is equipped with at least one manually-operated parking assembly, the method comprising: (a) initiating a parking verification process; (b) determining or receiving train data; (c) verifying at least one train parameter; (d) generating at least one prompt to activate at least one manually-operated parking assembly of at least one locomotive and/or at least one railcar; and (e) based upon operator input related to the at least one prompt, generating at least one prompt to activate or deactivate at least one component of the braking system.

In another preferred and non-limiting embodiment or aspect, provided is a parked train monitoring method for a train having a braking system, at least one locomotive, and at least one railcar, wherein the at least one locomotive and/or the at least one railcar is equipped with at least one manually-operated parking assembly, the method comprising: (a) when the train is not moving, determining or detecting at least one of the following: (i) the length of time that the train has not moved, (ii) the length of time that at least one component of the braking system has been activated, (iii) whether a specified process or procedure has been initiated or completed, or any combination thereof; and (b) based at least partially on the determination or detection, generating alarm data.

In a still further preferred and non-limiting embodiment or aspect, provided is a movement detection method for a train having at least one locomotive and at least one railcar, comprising: generating visual data based at least partially on visual signals collected by at least one visual data collection device; processing at least a portion of the visual data; and at least partially based upon the processing, determining at least one parameter associated with movement of at least a portion of the train.

In this manner, the present invention provides improved system and methods for train parking or movement verification or monitoring.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment or aspect can be combined with one or more features of any other embodiment or aspect.

What is claimed is:

1. A parking verification system for a train having a braking system including at least one manually-operated parking assembly arranged on at least one of a locomotive and a railcar of the train, the system comprising:

at least one on-board computer arranged on the train and programmed to:

(a) when the train is not moving, generate braking system test data related to at least one braking system parameter of the braking system;

(b) based at least partially on the braking system test data, determine between generating alarm data and initiating a non-parked mode for the train;

(c) after determining to initiate the non-parked mode for the train and movement of the train, determine whether the train has subsequently stopped moving; and (d) in response to determining that the train has subsequently stopped moving, repeat steps (a) and (b).

2. The parking verification system of claim 1, further comprising at least one operator interface programmed or configured to receive operator input.

3. The parking verification system of claim 2, wherein the on-board computer is further programmed or configured to generate at least one query requesting the input of train data.

4. The parking verification system of claim 3, wherein the train data comprises at least one of the following: operator name, operator identification, identification data, contact data, locomotive data, consist data, railcar data, location data, weight data, speed data, time data, grade data, payload data, braking system data, or any combination thereof.

5. The parking verification system of claim 2, wherein the on-board computer is further programmed or configured to generate at least one query requesting the input of braking system data.

6. The parking verification system of claim 5, wherein the braking system test data is at least partially based on at least a portion of the braking system data.

7. The parking verification system of claim 2, wherein at least a portion of the alarm data is visually displayed on the at least one operator interface.

8. The parking verification system of claim 1, wherein the alarm data comprises at least one of the following: visual data, aural data, tactile data, braking system test data, braking system data, train data, braking system parameter data, or any combination thereof.

9. A parking verification method for a train having a braking system including at least one manually-operated parking assembly arranged on at least one of a locomotive and a railcar of the train, the method comprising:

(a) when the train is not moving, generating braking system test data related to at least one braking system parameter of the braking system;

(b) based at least partially on the braking system test data, determining between generating alarm data and initiating a non-parked mode for the train;

(c) after determining to initiate the non-parked mode for the train and movement of the train, determining whether the train has subsequently stopped moving; and (d) in response to determining that the train has subsequently stopped moving, repeating steps (a) and (b).

10. The parking verification method of claim 9, further comprising receiving operator input through at least one operator interface.

11. The parking verification method of claim 10, further comprising generating at least one query requesting the input of train data.

12. The parking verification method of claim 11, wherein the train data comprises at least one of the following: operator name, operator identification, identification data, contact data, locomotive data, consist data, railcar data, location data, weight data, speed data, time data, grade data, payload data, braking system data, or any combination thereof.

13. The parking verification method of claim 10, further comprising generating at least one query requesting the input of braking system data.

14. The parking verification method of claim 13, wherein the braking system test data is at least partially based on at least a portion of the braking system data.

15. The parking verification method of claim 10, wherein at least a portion of the alarm data is visually displayed on the at least one operator interface.

16. The parking verification method of claim 9, wherein the alarm data comprises at least one of the following: visual data, aural data, tactile data, braking system test data, braking system data, train data, braking system parameter data, or any combination thereof.

* * * * *